US011342092B2

(12) United States Patent
Xu et al.

(10) Patent No.: US 11,342,092 B2
(45) Date of Patent: May 24, 2022

(54) ELECTROLYTE FOR ELECTROCHEMICAL DECONTAMINATION AND PREPARATION METHOD AND APPLICATION THEREOF

(71) Applicant: China Nuclear Sichuan Environmental Protection Engineering Co., Ltd., Guangyuan (CN)

(72) Inventors: Liguo Xu, Guangyuan (CN); Lingjun Zhao, Guangyuan (CN); Yanmin Cui, Guangyuan (CN); Yutong Di, Guangyuan (CN); Wenjie Gu, Guangyuan (CN)

(73) Assignee: China Nuclear Sichuan Environmental Protection Engineering Co., Ltd., Guangyuan (CN)

( * ) Notice: Subject to any disclaimer, the term of this patent is extended or adjusted under 35 U.S.C. 154(b) by 0 days.

(21) Appl. No.: 17/485,867

(22) Filed: Sep. 27, 2021

(65) Prior Publication Data

US 2022/0102020 A1 Mar. 31, 2022

(30) Foreign Application Priority Data

Sep. 28, 2020 (CN) ..... 202011038995.2

(51) Int. Cl.
*G21F 9/30* (2006.01)
*C25F 1/00* (2006.01)

(52) U.S. Cl.
CPC . *G21F 9/30* (2013.01); *C25F 1/00* (2013.01)

(58) Field of Classification Search
CPC ..... G21F 9/30; C25F 1/00
USPC ..... 205/723
See application file for complete search history.

(56) References Cited

U.S. PATENT DOCUMENTS 5,340,505 A 8/1994 Hanulik et al.

FOREIGN PATENT DOCUMENTS

| | | | |
|---|---|---|---|
| CN | 103343345 | A | 10/2013 |
| CN | 104389011 | A | 3/2015 |
| CN | 106158060 | A | 11/2016 |
| CN | 106409372 | A | 2/2017 |
| CN | 109913936 | A | 6/2019 |
| CN | 110257891 | A | 9/2019 |
| EP | 0483053 | A1 | 4/1992 |
| GN | 112176393 | B | 9/2021 |
| JP | 60234998 | A | 11/1985 |
| JP | 2012198027 | A | 10/2012 |

OTHER PUBLICATIONS

First Office Action dated May 6, 2021 for Chinese Application No. 2021042802125920 (9 pages).
Kim Dong-Yeon et al., "Effect of the Addition of Oxalic Acid to the Phosphoric Acid Electrolyte on the Electro-decontamination Behavior of the SUS Metal Surface", 2017, Proceedings of the Korean Waste Society Conference (3 pages).
First Office Action dated May 6, 2021 for Chinese Application No. 20211038995.2 (16 pages).
Notification to Grant Patent Right for Invention dated Jul. 13, 2021 for Chinese Application No. 20211038995.2 (3 pages).

*Primary Examiner* — Edward M Johnson
(74) *Attorney, Agent, or Firm* — Paul D. Bianco; Gary S. Winer; Fleit Intellectual Property Law

(57) ABSTRACT

An electrolyte for electrochemical decontamination and a preparation method and application thereof. The electrolyte is an aqueous solution including the following solutes: phosphoric acid, oxalic acid, citric acid, tartaric acid, hydrogen peroxide and glacial acetic acid. The electrolyte has a good decontamination effect and allows for fast decontamination and is obtained by reasonably combining different types of solutes and controlling the levels of the solutes and resulting secondary waste solution and residues are easy to treat. The electrolyte is suitable for overall or local electrochemical decontamination of radioactively contaminated stainless steel scrap.

6 Claims, No Drawings

ELECTROLYTE FOR ELECTROCHEMICAL DECONTAMINATION AND PREPARATION METHOD AND APPLICATION THEREOF

TECHNICAL FIELD

The present disclosure relates to the technical field of radioactive waste treatment, and in particular, to an electrolyte for electrochemical decontamination and a preparation method and application thereof.

BACKGROUND ART

The nuclear activities of human relate to the nuclear industry, civil nuclear technology, scientific research technology, etc. All of these processes involve radioactive materials, and the materials in contact are contaminated by radionuclides. During nuclear activities, when operations such as maintenance or decommissioning of nuclear facilities are required, they need to be decontaminated to reduce occupational exposure and potential release of radioactive materials, and old facilities can be recycled. Metal materials commonly used in nuclear facilities include stainless steel and carbon steel, among which stainless steel is often used to store and transport strong radioactive pollutants.

For radioactively contaminated metal materials, physical, chemical and electrochemical methods are mainly used for decontamination at home and abroad.

Physical decontamination, also known as mechanical decontamination, is the elimination of surface radioactive contamination by physical methods, such as washing, brushing, vacuuming, wiping, high-pressure jet and ultrasonic methods. The physical decontamination process is simple with low decontamination cost and can be used on both metal and non-metal surfaces. Unfortunately, the physical decontamination process also has obvious shortcomings, for example, generation of a large amount of radioactive dust, which will seriously endanger the health of operators, and formation of an explosive mixture in some cases. Physical decontamination techniques will damage surfaces and are not suitable for facilities and equipment needing to be reused.

Chemical decontamination is widely used in nuclear and other related fields. It is mainly used to remove fixed contamination and realize chemical transfer and remove contaminants with the help of chemical reagents. The chemical decontamination has the advantages of simple conditions, high operability, and good decontamination effect. However, chemical decontamination methods have the disadvantages of high consumption of chemical reagents, high costs, long treatment durations, large amount of radioactive waste solution generated, and need for professional personnel to operate.

Electrochemical decontamination is a new method that has developed rapidly in recent years. Its principle is to remove radioactive contamination on the surface of an electrically conductive material through electrochemical action. The electrochemical decontamination has the advantages of high decontamination ability, short treatment durations, low consumption of chemical reagents, and high removal efficiency for fixed contamination. However, there is a need to develop a suitable decontamination electrolyte to achieve a good decontamination effect. To meet the requirements in practice use, a decontamination electrolyte should have such properties as stability at high electric current density, capability of containing high concentrations of ions and salts, and resistance to precipitation.

In fact, existing electrolytes for electrochemical decontamination often contain components such as nitric acid, sulfuric acid, hydrochloric acid, or corresponding acid radical ions. The resulting waste solution from electrochemical decontamination typically needs to be solidified. A nitric acid system may be compatible with a solidification system for radioactive waste solution and needs to be replaced in time according to radioactive levels to avoid the formation of strong radioactive or transuranic waste. Sulfuric acid and hydrochloric acid may be incompatible with the solidification system for radioactive waste solution, resulting in large output and difficult treatment of waste decontamination solution. As a result, the use of electrochemical decontamination methods in radioactive decontamination is greatly restricted.

According to the existing literature, an alkaline electrolyte containing a high concentration of sodium phosphate can be used for decontamination of radioactively contaminated stainless steel scrap, and during the decontamination process, the welded joints of the stainless steel may be preferentially oxidized, causing structural damage and resulting in formation of various undesirable nitrogen-containing products. An alkaline electrolyte containing a sulfate (such as sodium sulfate) has the advantages of an ideal decontamination effect, good surface condition of the stainless steel after electrolysis, and low required voltage and current, and thus has been practically used. However, such an electrolyte is incompatible with a radioactive waste solution treatment system, resulting in very complicated waste solution treatment and high cost.

Patent Application No. 201410708820.6 provides a decontamination solution based on a nitric acid system. The resulting secondary waste solution includes ferric nitrate and unreacted nitric acid and needs to be added with alkali to adjust the pH to a range of 8 to 12 before solidification. Consequently, a large amount of radioactive cement solidified wastes may be generated.

Patent Application No. 201910598331.2 discloses a decontamination electrolyte and a decontamination method. The decontamination electrolyte includes 5%-15% by volume of nitric acid, 15 g/L to 25 g/L of a nitrate, and 1 g/L to 5 g/L of an oxalate. The decontamination electrolyte needs to be replaced in time according to radioactive levels, thereby avoiding formation of transuranic waste.

In short, the current electrochemical decontamination of radioactively contaminated stainless steel scrap has the problems of lack of suitable electrolyte, poor decontamination effect, and difficult treatment of secondary waste solution.

SUMMARY

In view of the above problems, the present disclosure provides an electrolyte for electrochemical decontamination and a preparation method and application thereof. The electrolyte for electrochemical decontamination provided in the present disclosure has a good decontamination effect on radioactively contaminated stainless steel scrap and allows for fast decontamination, and resulting secondary waste solution and residues are easy to treat.

To achieve the objective of the present disclosure, the present disclosure provides the following technical solutions.

Provided is an electrolyte for electrochemical decontamination, which is an aqueous solution including the following solutes by mass:

45% to 80% by mass of phosphoric acid, 5 g/L to 10 g/L of oxalic acid, 1 g/L to 10 g/L of citric acid, 1 g/L to 2 g/L of tartaric acid, 1 g/L to 5 g/L of hydrogen peroxide, and 5 g/L to 10 g/L of glacial acetic acid.

Preferably, the electrolyte for electrochemical decontamination may include 50% to 70% by mass of the phosphoric acid, 5.5 g/L to 8 g/L of the oxalic acid, 2 g/L to 7 g/L of the citric acid, 1.5 g/L to 2 g/L of the tartaric acid, 2 g/L to 4 g/L of the hydrogen peroxide, and 6 g/L to 10 g/L of the glacial acetic acid.

Preferably, the electrolyte for electrochemical decontamination may include 60% by mass of the phosphoric acid, 6 g/L of the oxalic acid, 5 g/L of the citric acid, 2 g/L of the tartaric acid, 2.5 g/L of the hydrogen peroxide, and 10 g/L of the glacial acetic acid.

The present disclosure provides a preparation method of the electrolyte for electrochemical decontamination described above, including the following step: mixing the phosphoric acid, the oxalic acid, the citric acid, the tartaric acid, the hydrogen peroxide and the glacial acetic acid with water to obtain the electrolyte for electrochemical decontamination.

The present disclosure provides application of the electrolyte for electrochemical decontamination described above in decontamination of radioactively contaminated stainless steel scrap.

The present disclosure provides an electrolyte for electrochemical decontamination, which is an aqueous solution including the following solutes: phosphoric acid, oxalic acid, citric acid, tartaric acid, hydrogen peroxide and glacial acetic acid. The phosphoric acid is a moderate-strength inorganic acid and can cause different degrees of corrosion to metal materials. The oxalic acid is capable of well complexing with metal ions such as iron ion and chromium ion, promoting continuous anodic dissolution of metals and preventing cathodic reduction thereof, thus being conducive to decontamination reaction. The citric acid is capable of well complexing with iron ions, thereby further promoting the dissolution of iron, the principal component in stainless steel. The glacial acetic acid and the tartaric acid are highly corrosive to stainless steel. The hydrogen peroxide has strong oxidizing property. According to the present disclosure, an electrolyte for electrochemical decontamination that has a good decontamination effect and allows for fast decontamination is obtained by reasonably combining different types of solutes and controlling the levels of the solutes, and resulting secondary waste solution and residues are easy to treat. The electrolyte for electrochemical decontamination is suitable for overall or local electrochemical decontamination of radioactively contaminated stainless steel scrap.

In the electrolyte for electrochemical decontamination provided in the present disclosure, the oxalic acid, the citric acid, the tartaric acid and the glacial acetic acid are organic acids and no N and Cl ions are present, which may be highly advantageous for a glass solidification system for spent decontamination solution. The resulting waste solution from the treatment of radioactively contaminated stainless steel scrap with the electrolyte for electrochemical decontamination provided in the present disclosure is a major component of iron phosphate glass and can be treated readily by the glass solidification system.

In addition, during electrochemical decontamination with the electrolyte provided in the present disclosure, the electrolyte reacts with stainless steel to produce iron phosphate precipitate. Radionuclides are mainly present in the precipitate. The precipitate is subjected to glass solidification without formation of transuranic waste. Moreover, the electrolyte may only cause little radioactive contamination and thus may be supplemented just at a reduced liquid level with no need for replacement in use.

DETAILED DESCRIPTION OF THE EMBODIMENTS

The present disclosure provides an electrolyte for electrochemical decontamination, which is an aqueous solution including the following solutes: phosphoric acid, oxalic acid, citric acid, tartaric acid, hydrogen peroxide and glacial acetic acid.

In the present disclosure, the electrolyte for electrochemical decontamination includes 45% to 80%, preferably 50% to 70%, more preferably 55% to 65% by mass of phosphoric acid. In the present disclosure, the phosphoric acid is a moderate-strength inorganic acid and can cause different degrees of corrosion to metal materials, thereby being conducive to removing a contamination layer on the surface of radioactively contaminated stainless steel scrap.

In the present disclosure, the electrolyte for electrochemical decontamination includes 5 g/L to 10 g/L, preferably 5.5 g/L to 8 g/L, more preferably 6 g/L of oxalic acid. In the present disclosure, the oxalic acid is capable of well complexing with metal ions such as iron ion and chromium ion, promoting continuous anodic dissolution of metals and preventing cathodic reduction thereof, thus being conducive to decontamination reaction.

In the present disclosure, the electrolyte for electrochemical decontamination includes 1 g/L to 10 g/L, preferably 2 g/L to 7 g/L, more preferably 5 g/L of citric acid. In the present disclosure, the citric acid is capable of well complexing with iron ions, thereby further promoting the dissolution of iron, the principal component in stainless steel.

In the present disclosure, the electrolyte for electrochemical decontamination includes 1 g/L to 2 g/L, preferably 1.5 g/L to 2 g/L, more preferably 2 g/L of tartaric acid.

In the present disclosure, the electrolyte for electrochemical decontamination includes 5 g/L to 10 g/L, preferably 6 g/L to 10 g/L, more preferably 10 g/L of glacial acetic acid. In the present disclosure, the glacial acetic acid and the tartaric acid are highly corrosive to stainless steel and can facilitate the removal of the contamination layer on the surface of radioactively contaminated stainless steel scrap.

In the present disclosure, the electrolyte for electrochemical decontamination includes 1 g/L to 5 g/L, preferably 2 g/L to 4 g/L, more preferably 2.5 g/L of hydrogen peroxide. In the present disclosure, the hydrogen peroxide has strong oxidizing property and is conducive to the removal of the contamination layer on the surface of radioactively contaminated stainless steel scrap.

In the present disclosure, a solvent of the electrolyte for electrochemical decontamination is water. The water is not particularly limited herein, and commonly used water in the art can be used.

The present disclosure provides a preparation method of the electrolyte for electrochemical decontamination described above, including the following step: mixing phosphoric acid, oxalic acid, citric acid, tartaric acid, hydrogen peroxide and glacial acetic acid with water to obtain the electrolyte for electrochemical decontamination.

The method of mixing is not particularly limited herein, and a mixing method which is well known to a person skilled in the art and can enable complete dissolution and full mixing of different raw materials can be used. Reagents for preparing the electrolyte are preferably industrial pure reagents.

The present disclosure further provides application of the electrolyte for electrochemical decontamination described above in decontamination of radioactively contaminated stainless steel scrap. In a specific embodiment of the present disclosure, the application is preferably as follows: adding the electrolyte for electrochemical decontamination to an electrolytic tank, immersing a portion to be decontaminated of radioactively contaminated stainless steel scrap in the electrolyte for electrochemical decontamination, and connecting the stainless steel to an anode for electrolysis. In the present disclosure, the electrolysis occurs under the following conditions: a voltage, preferably a pulsed voltage which preferably has a strength of 24 V; an electric current density, preferably 0.5-2 A/cm$^2$; and electrolysis time, preferably 120 seconds.

During electrochemical decontamination of radioactively contaminated scrap metals by the method provided in the present disclosure, little decontamination solution may be left when equipment stops running, and minimal secondary waste solution may be generated. In the present disclosure, after the decontamination is completed, the electrolyte cannot be reused and thus turns to waste electrolyte. The major components of the waste electrolyte are substances such as phosphoric acid and oxalic acid, i.e., main components for preparing iron phosphate. The waste electrolyte is preferably subjected to glass solidification. The specific method of the glass solidification is not particularly limited herein, and a method well known to a person skilled in the art can be used.

The technical solutions in the present disclosure will be clearly and completely described below in conjunction with the examples of the present disclosure.

Pollution episodes of radioactively contaminated stainless steel sheets used in the examples are as follows: α contamination: 100 Bq/cm$^2$, and βcontamination: 2000 Bq/cm$^2$.

Example 1

Electrochemical decontamination was performed on radioactively contaminated stainless steel scrap by using the electrolyte for electrochemical decontamination provided in the present disclosure. The used electrolyte was composed of 60wt % of phosphoric acid, 5 g/L of oxalic acid, 2 g/L of citric acid, 1 g/L of tartaric acid, 2.5 g/L of hydrogen peroxide, and 5 g/L of glacial acetic acid, and water as a solvent.

An appropriate amount of the electrolyte was added to an electrolytic tank. A portion to be decontaminated of a radioactively contaminated stainless steel sheet was immersed in the electrolyte for electrochemical decontamination, and the stainless steel sheet was connected to an anode for electrolysis under the conditions of a pulsed voltage of 24 V and an electric current density of 0.5-2 A/cm$^2$ for 120 seconds. The decontaminated stainless steel sheet was then rinsed with deionized water. It was measured that the stainless steel sheet had a weight loss of 6.4 mg/cm$^2$. The surface radioactive levels of the stainless steel sheet were measured as follows: α contamination below a detection line, and β contamination <0.2 Bq/cm$^2$, which met the requirement of reuse.

The resulting waste solution and residues from the electrolysis were fed into a glass solidification system for the preparation of iron phosphate glass.

Example 2

Electrochemical decontamination was performed on radioactively contaminated stainless steel scrap by using the electrolyte for electrochemical decontamination provided in the present disclosure. The used electrolyte was composed of 45% of phosphoric acid, 5 g/L of oxalic acid, 10 g/L of citric acid, 2 g/L of tartaric acid, 2.5 g/L of hydrogen peroxide, and 5 g/L of glacial acetic acid, and water as a solvent.

The operation method for electrolytic decontamination was the same as that in Example 1. It was measured that the stainless steel sheet had a weight loss of 8.0 mg/cm$^2$. The surface radioactive levels of the stainless steel sheet were measured as follows: α contamination below a detection line, and β contamination <0.2 Bq/cm$^2$, which met the requirement of reuse.

The resulting waste solution and residues from the electrolysis were fed into a glass solidification system for the preparation of iron phosphate glass.

Example 3

Electrochemical decontamination was performed on radioactively contaminated stainless steel scrap by using the electrolyte for electrochemical decontamination provided in the present disclosure. The used electrolyte was prepared from 50% of phosphoric acid, 10 g/L of oxalic acid, 6 g/L of citric acid, 1/L of tartaric acid, 5 g/L of hydrogen peroxide, and 10 g/L of glacial acetic acid, and water as a solvent.

The operation method for electrolytic decontamination was the same as that in Example 1. It was measured that the stainless steel sheet had a weight loss of 5.7 mg/cm$^2$. The surface radioactive levels of the stainless steel sheet were measured as follows: α contamination below a detection line, and β contamination <0.2 Bq/cm$^2$, which met the requirement of reuse.

The resulting waste solution and residues from the electrolysis were fed into a glass solidification system for the preparation of iron phosphate glass.

The foregoing are merely descriptions of preferred embodiments of the present disclosure. It should be noted that a person of ordinary skill in the art can make several improvements and modifications without departing from the principle of the present disclosure, and such improvements and modifications should be deemed as falling within the protection scope of the present disclosure.

What is claimed is:

1. An electrolyte for electrochemical decontamination, wherein the electrolyte for electrochemical decontamination is an aqueous solution comprising the following solutes by mass:

45% to 80% by mass of phosphoric acid, 5 g/L to 10 g/L of oxalic acid, 1 g/L to 10 g/L of citric acid, 1 g/L to 2 g/L of tartaric acid, 1 g/L to 5 g/L of hydrogen peroxide, and 5 g/L to 10 g/L of glacial acetic acid.

2. The electrolyte for electrochemical decontamination according to claim 1, wherein the electrolyte for electrochemical decontamination comprises 50% to 70% by mass of the phosphoric acid, 5.5 g/L to 8 g/L of the oxalic acid, 2 g/L to 7 g/L of the citric acid, 1.5 g/L to 2 g/L of the tartaric acid, 2 g/L to 4 g/L of the hydrogen peroxide, and 6 g/L to 10 g/L of the glacial acetic acid.

3. The electrolyte for electrochemical decontamination according to claim 1, wherein the electrolyte for electrochemical decontamination comprises 60% by mass of the phosphoric acid, 6 g/L of the oxalic acid, 5 g/L of the citric acid, 2 g/L of the tartaric acid, 2.5 g/L of the hydrogen peroxide, and 10 g/L of the glacial acetic acid.

4. A preparation method of the electrolyte for electrochemical decontamination according to claim 1, comprising the following step: mixing the phosphoric acid, the oxalic acid, the citric acid, the tartaric acid, the hydrogen peroxide and the glacial acetic acid with water to obtain the electrolyte for electrochemical decontamination.

5. A preparation method of the electrolyte for electrochemical decontamination according to claim 2, comprising the following step: mixing the phosphoric acid, the oxalic acid, the citric acid, the tartaric acid, the hydrogen peroxide and the glacial acetic acid with water to obtain the electrolyte for electrochemical decontamination.

6. A preparation method of the electrolyte for electrochemical decontamination according to claim 3, comprising the following step: mixing the phosphoric acid, the oxalic acid, the citric acid, the tartaric acid, the hydrogen peroxide and the glacial acetic acid with water to obtain the electrolyte for electrochemical decontamination.

* * * * *